United States Patent [19]

Spengler

[11] Patent Number: 4,622,771

[45] Date of Patent: Nov. 18, 1986

[54] COMMUNICATION DISPLAY DEVICE

[76] Inventor: Charles W. Spengler, 3310 Deforest Ave., Cincinnati, Ohio 45209

[21] Appl. No.: 750,519

[22] Filed: Jul. 1, 1985

[51] Int. Cl.[4] ..... G09F 13/00

[52] U.S. Cl. ..... 40/547; 40/457; 446/219; 446/297

[58] Field of Search ..... 40/411, 416, 421, 425, 40/547, 457; 434/83, 268, 270, 267; 446/219, 297, 301, 385

[56] References Cited

U.S. PATENT DOCUMENTS

| | | | |
|---|---|---|---|
| 1,951,422 | 3/1934 | Klemperer | 434/270 |
| 2,047,377 | 7/1936 | Liwschutz | 40/412 |
| 2,152,296 | 3/1939 | Weiss et al. | 40/416 |
| 2,250,916 | 7/1941 | Magruder | 40/416 |
| 2,270,142 | 1/1942 | Robinson et al. | 40/414 |
| 2,528,968 | 11/1950 | Nelson et al. | 40/419 |
| 2,538,162 | 1/1951 | Morin | 446/360 |
| 2,633,651 | 4/1953 | Nelson et al. | 40/419 |
| 2,671,984 | 3/1954 | Morin | 40/419 |
| 2,700,250 | 1/1955 | Williams | 40/416 |
| 2,825,260 | 3/1958 | O'Brien | 57/248 |
| 2,867,049 | 1/1959 | Brackensey | 40/457 |
| 2,871,593 | 2/1959 | Roberts | 40/457 |
| 2,890,535 | 6/1959 | Kenworthy | 40/457 |
| 2,992,587 | 7/1961 | Hicks, Jr. et al. | 350/96.25 |
| 3,277,594 | 10/1966 | Rogers et al. | 40/457 |
| 3,589,793 | 6/1971 | Curtiss | 350/96.24 |
| 3,625,669 | 12/1971 | Norton | 65/4.21 |
| 3,626,040 | 12/1971 | Nagao et al. | 264/1.5 |
| 3,662,374 | 5/1972 | Harrison, III et al. | 340/725 |
| 3,715,822 | 2/1973 | Hansen, Jr. et al. | 40/547 |
| 4,068,118 | 1/1978 | Carrington | 40/547 |
| 4,177,589 | 12/1979 | Villa | 40/457 |
| 4,207,704 | 6/1980 | Akiyama | 446/301 |
| 4,417,412 | 11/1983 | Sansom | 40/547 |

FOREIGN PATENT DOCUMENTS

| | | | |
|---|---|---|---|
| 2400743 | 4/1979 | France | 40/547 |

OTHER PUBLICATIONS

Martin, Deac, *Juno the Symbol of All Women,* Cleveland Health Museum, 1958.

*Primary Examiner*—Robert P. Swiatek
*Assistant Examiner*—Cary E. Stone
*Attorney, Agent, or Firm*—Wood, Herron & Evans

[57] ABSTRACT

A communication display device for simulating a humanoid or other animal structure. Fiber optic light elements are included with the device to simulate movement of various parts such as the joints, eyes or mouth for purposes of communication. Sound synchronization is also provided with the fiber optic light simulated body movements. The display device is effective in reaching the conscious and subconscious states of individuals with both vocal and non-vocal communications.

15 Claims, 2 Drawing Figures

COMMUNICATION DISPLAY DEVICE

BACKGROUND OF THE INVENTION

Display devices simulating a humanoid or other animal structures have long been used in advertising. The objective of such devices is to communicate and interact with individuals, frequently potential buyers of goods and services, in such a manner so that a message is delivered. Success or failure in such advertising display devices often is dependent upon the first impression. First impressions are made of the things people notice about the display device during the crucial first minute or so, even seconds, upon encountering it. If that first impression is a positive one, it will pay big dividends in communicating the message sought to be delivered. It has also been found that display devices may be extremely effective in reaching the subconscious state of an individual and obtaining a desired response from the individual.

Display devices that have been developed primarily depend upon communication by appearance and sound. First, people tend to focus on what they can see. Social scientists may disagree on the precise sequence by which individuals process information, however, experts believe that appearance constitutes more than one half of the total message. Even without uttering a sound, it is believed that more than 50% of the meaning of the message is conveyed by facial expressions and body language alone. Next, people focus on what they can hear. The sound may transmit a substantial percentage of the meaning in face-to-face transmissions. Sound conveys a great deal more information when it is combined with body language such as facial expressions, gestures, eye contact and other movement. Interestingly, social scientists conclude that the actual words communicated in the first few mcments or minutes of an encounter with a display device only contribute less than ten percent to the meaning. It is not that the words are unimportant, obviously, but if others do not like what they see, or if they get past the body language of the display device only to be stopped by sound, then that person may not care at all about what voice message is delivered. The mind of the observer of a display device is usually already made up by the first impression that has been made.

A number of display devices have been disclosed in the patent literature. For instance, the patent literature may be represented by the following U.S. Pat. Nos. 2,047,377; 2,152,296; 2,250,916; 2,270,142; 2,528,968; 2,538,162; 2,633,651; 2,671,984; 2,700,250; 2,867,049; 2,871,593; 2,890,535; 3,277,594; 3,662,374; 4,177,589 and 4,207,704. It is not intended by the listing of these patents that they are relevant to the invention described hereinafter, but rather they are offered to serve as background in the general field of display devices and particularly animated apparatus. Briefly, these listed patents represent the effort that has been made to create display devices, especially that simulate a human being. Often a plurality of movable members are combined in the device and arranged upon activation to cause animation. Various control mechanisms and electronics are often coupled to the movable members for mechanical activation thereof. In addition, often a sound reproducer is disposed in the proximity of the display device and connections are made between the moveable member mechanism and the sound reproducer such that sound is responsive to the mechanical movement. The devices of the prior patents are also particularly directed to an automatic generation of a mouth display and animation of the mouth in response to the sound. For instance, patents are directed to automatic synchronization of movement of a computer generated mouth to movement of a real mouth uttering words. Such devices and other devices have been proposed to animate lip movement.

There is a need for further improvements in communication display devices. Improvements in non-verbal and verbal communication devices are needed so that images may be properly and effectively communicated.

SUMMARY OF THE INVENTION

This invention is directed to a communication display device that provides a see-through structure. The see-through structure is made up of interconnecting tubes which form substantially fixed body, torso, head and limb parts. This see-through display device is particularly adapted to effectively communicate both non-verbally and verbally without precluding the observer from seeing merchandise or other items which may be behind it. Furthermore, with such a see-through structure, shop-lifters are prevented from hiding behind the display device or using it to enable them to pilfer items from the store in which the display device may be used.

In another feature of the invention, the tubular see-through structure provides a humanoid or animal appearance as a means to communicate with both the conscience and subconscience of an observer. In a preferred form, an artistic see-through structure communicates with an individual solely by body language. For instance, in the case of communication with customers involving dietary products, the structure may be modified to promote a thin looking appearance for nonverbal communication. In an especially preferred form, the tubular parts of the see-through structure provide a conduit for fiber optical elements which are employed to convey light from a source to various parts of the structure so that body movement of the device may be simulated. By such fiber optic means, pulsating light delivered to various parts of the fixed body structure, such as the lips, eyes and limbs, may stimulate movement. A person's peripheral vision assumes changes in light intensity as movement. Thus, the display structure whose parts are otherwise substantially fixed, and thereby the structure is rigid or durable, may nevertheless provide simulated movement of parts to attract and non-verbally communicate with a potential buyer of goods and services.

In another aspect of the invention, the simulated body movement, particularly with the eyes and lips of the display device, may be coordinated with sound. Computer operated voice recognition or synthesis may be made responsive to such movement. As a result, a humanoid device is provided by this invention so that realistic communications may be delivered to an observer. In such a fashion, the conscious as well as subconscious of an individual may be reached by communication in a direct as well as a peripheral sense.

These and other advantages of this invention will be further understood with reference to the drawings and the detailed description.

DETAILED DESCRIPTION

Figure 1:
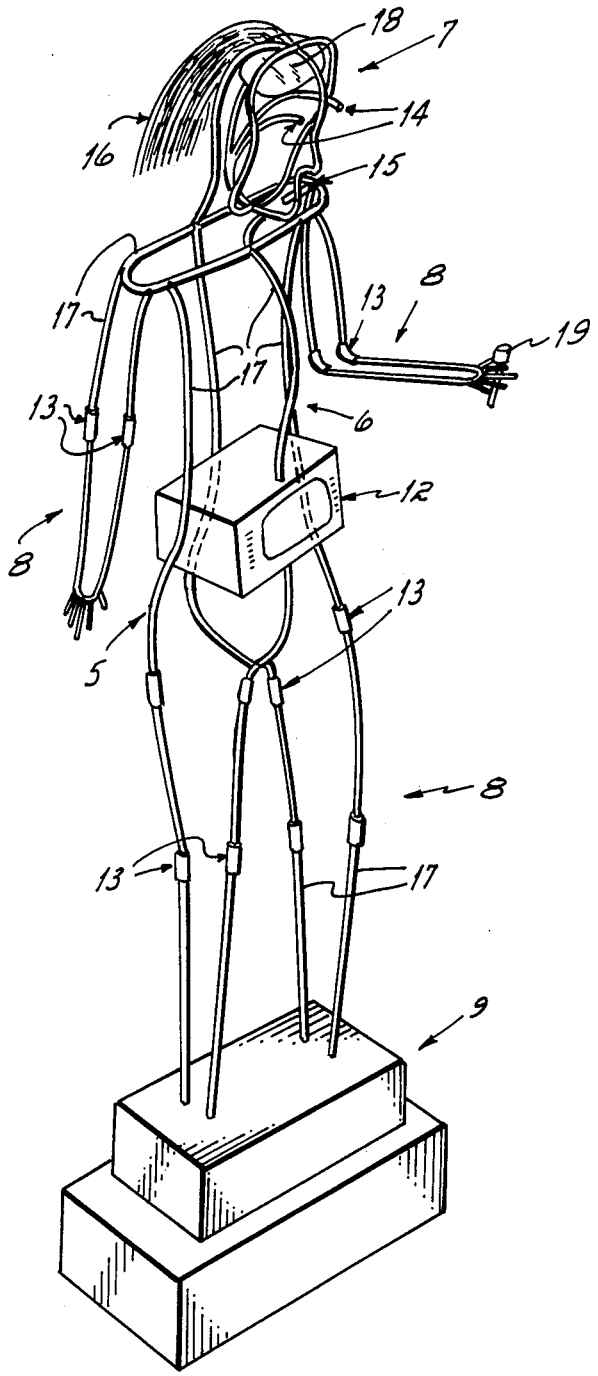
FIG. 1 illustrates a full vertical view of a humanoid structure embodying the principles of this invention.
Figure 2:
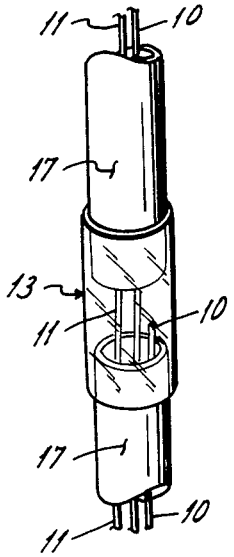
FIG. 2 is an enlarged view of a typical joint of the tubular structure of FIG. 1 further illustrating fiber optical means to simulate body movement and other features in accordance with this invention.

FIG. 1 illustrates one form of a communication display device in accordance with this invention. The structure of FIG. 1 is in the form of a human or animal. In general, the structure is a tubular see-through structure having substantially fixed body 5, torso 6, head 7 and limb 8 parts. The tubular structure is substantially fixed for durability and rigidity in a base 9. Yet, in a most preferred form, the tubular components provide means for conveying fiber optical elements 10 which may be employed to simulate movement of the joints 13, eyes 14 or mouth/lips 15 by the light displayed at the ends or exposed cross-sections of the fiber optical elements. In addition, control leads 11 may be housed in the tubular parts which service a speaker, video monitor and/or other such communication means. The tubular parts can either be made out of plastic or polymeric materials. The tubes may be solid or hollow. Additionally, the tubular structure may be made out of metal such as aluminum, or the like, and have diameters in the range of about $\frac{3}{4}$ to about 1 inch. A voice recognition or synthesis apparatus may also be separately housed in the communication means 12 or a body portion not shown. Alternatively, such apparatus may be included in the base 9. A light source or pulsating light source for the fiber optic elements (not shown) can also be housed in base 9. Sound reproducing means may also be housed in the base 9 and the fiber optical light source may be operated intermittently and at such frequencies so that the light projecting from the ends or exposed sections of the fiber optical elements 10 may be coordinated to enhance verbal messages or images of the display structure at the lips, eyes or joints. The hair 16 of the device may be made of fiber optic elements 10. Such fiber optic light display may be achieved at a joint shown by FIG. 2 by partially exposing a number of fiber optical element ends of a bundle of thousands of such elements so that light is seen at such exposed ends.

In the head 7, there is housed a clear plastic element 18 somewhat naturally or spherically shaped having fiber optic terminals. Thus, animation may be simulated in the brain in a manner very similar to human brain activity. Auditory inputs can be processed in the plastic element 18 in the same location as in a human brain. For example, a hand-held mike 19 may receive sounds from a customer which will be transmitted in form of light to the auditory section of the brain for display. The microphone pickup may be placed in a fingertip (not shown). Thus, transmitted light and/or sound enable the device to effectively communicate with the customer.

Fiber optics is a well known and developed science. Such fiber optical elements which are suitable for use in accordance with the principles of this invention are well known and the details per se form no part of this invention. Fiber optic materials and methods of their preparation which are suitable for use in this invention are described in U.S. Pat. Nos. 2,825,260; 2,992,587; 3,589,793; 3,625,699 and 3,626,040. Reference is also made to the brochure entitled "Fiber Optics; Principles, Properties and Design Consideration" by Walter P. Siegmund, American Optical Corporation, November 1970, for a discussion of the history of fiber optics, its principles, formulas for lens optics and numerical apertures of light-guide fibers, suitable fiber materials, etc., and such will advise a person of ordinary skill with the necessary information concerning fiber optics to practice this invention. Also, reference is made to the 1966 book of ASTM Standards, Part 13, "Refractories; Glass, Ceramic Materials; Manufactured Carbon and Graphite Products", published by The American Society for Testing Materials for definition of optical glasses which fall into the categories of high refractive index glasses and lower refractive index glasses. However, many different fiber optical materials are available on the market. Particularly, the various types of glass fiber optical elements manufactured by American Optical Corporation and designated types 50C, 70C, 70A, 73A, 47C and 47A which possess fiber core sizes on the order of about 5 to about 15 microns and having numerical apertures within the range of about 0.88 through about 1.0, respectively, are suitable. Plastic fiber optic material such as an acrylic plastic monofilament core with a polymer cladding is available from DuPont Co., Wilmington, Del., and is referred to as CLOE grade fiber.

Speech recognition, synthesis and speaker recognition means are provided in more preferred embodiments of this invention. The speech recognition, synthesis and speaker means is also well developed and the details of such means form no part of this invention. Such products may be independently obtained from a number of sources and reference is therefore made to the literature on the subject in order that one of ordinary skill in the art may practice these embodiments of this invention. Reference is made to *BYTE* by McGraw-Hill, Vol. 9, No. 1 (January 1984) "Speech Recognition: An Idea Whose Time is Coming" by George M. White for a list of names and manufacturers of products on the market for use in connection with speech recognition, synthesis and speaker recognition. Furthermore, reference is made to the International Conference on Acoustics, Speech and Signal Processing wherein such publications as "Speech Recognition Performance Assessments and Available Data Bases" by Baker et al were presented in April of 1983 as published by the Institute of Electrical and Electronic Engineers, Acoustics, Speech and Signal Processing Society. Specific products exist in the marketplace by such companies as Interstate Voice Products, Dragon Systems, Inc., Votan and other companies whose names are provided in the above literature. As mentioned, the details of such devices for voice synthesis or recognition are well known and form no part of this invention. However, the use of such devices in combination with the communication display device of this invention or the coordination of the sounds with the fiber optical means is considered to be a completely unique approach to advertising and communication.

The display device illustrated in the drawings of this invention will function therefore to provide a see-through structure and thereby avoid the problems associated heretofore with animated structures which do not have such a feature. For example, the display devices of the prior patents listed above are not see-through, but rather are constructed in solid body forms. The see-through structure, as mentioned, prevents shop-lifters from hiding behind it. The see-through structure also allows the customer more complete visual access of the store. In addition, by means of the tubular structure combined with fiber optical means, body movement of the otherwise fixed structure is simulated. The rigidity of the structure and its stability without movement of the body parts enables it to be fabricated in rather simple fashion. Yet, by means of fiber optical means, movement of the body parts such as joints, eyes and mouth may be simulated. Such fiber optical simulation of movement is considered very unique in a fixed display device. Further, as mentioned above, such movement simulation may be coordinated with voice synthesis or recognition. In the preferred form shown in FIG. 2 of the drawings, a metal tube 17 may house the fiber optical elements 10 constructed in accordance with the references incorporated herein above. At the joints, a clear plastic sleeve 13 is provided between the metal tubes 12 to render visible the ends of the fiber optic elements 10 which will convey the light. The conveyance of the light may then be coordinated with voice synthesis. The body parts such as eyes 14 and lips 15 may move in synchronization with the sound. For instance, such tubular eyes 14 and lips 15 are adapted to also provide exposed fiber optic elements to simulate movement by light transmission from a light source in the base 9 to the end of the fibers located in the tubular eyes 14 and lips 15. Application and operation of the display device illustrated is therefore readily understood. Control leads or electrical leads that may be necessary for either video monitoring or speakers are also housed in the tubular structure. In operation, in a most preferred form, the display device functions in a number of different ways. First, when the see-through structure is used without voice communication, a message may be delivered by printed words or picture through the monitor 12, for instance. Furthermore, the structure itself when fabricated into other humanoid or animal forms may in and of itself convey the message to the observer. For instance, the tubular structure may be fabricated into a recognizable trademark or a person which in and of itself will therefore communicate a message to the observer. Furthermore, sound tapes may be housed in the base 9 or monitoring means 12 and such a tape may be periodically played so that oral communication may supplement the body language. As indicated above, when fiber optical means are associated with the structure, the light simulation of movement at the joints, eyes and lips, for example, may further provide body language with or without voice synthesis and recognition.

Therefore, it will be understood that the see-through structure of this invention provides a unique means for the communication of verbal and non-verbal information used in advertising. In addition, facial expressions and movement may be simulated to communicate with the conscious and subconscious of an observer. Having described this invention, and its most preferred forms, obvious variations will be apparent to a person of skill in this art without departing from the true spirit and scope of this invention.

What is claimed is:

1. A communication display device comprising a see-through tubular structure in the form of an animal, said structure having substantially fixed body, torso, head and limb tubular parts having diameters in the range of about ¾ to about 1 inch, said tubular structure providing the means for communication verbally or nonverbally with an observer without precluding the observer from seeing merchandise or other items which may be behind said structure.

2. The communication display device of claim 1 further including means for producing sound.

3. A communication display device comprising a see-through tubular structure in the form of an animal, said structure having substantially fixed body, torso, head and limb parts, said tubular structure providing the means for communication with an observer, wherein fiber optical elements are supported by said structure and means are provided for displaying light through said fiber optical elements for simulating movement of at least one of said structure parts.

4. The communication display device of claim 3 wherein the tubular structure provides fiber optical means in the structure limb parts for simulating movement of said parts.

5. A communication display device comprising a see-through tubular structure in the form of an animal, said structure having substantially fixed body, torso, head and limb parts, said tubular structure providing the means for communication with an observer, wherein said head structure includes fiber optical elements simulating lips or eyes parts for simulating movement of said lips or eyes parts.

6. A communication display device comprising a see-through tubular structure in the for of an animal, said structure having substantially fixed body, torso, head and limb parts, said tubular structure providing the means for communication with an observer, means for producing sound, further including fiber optical means for simulating movement of any of said substantially fixed parts.

7. The communication display device of claim 6 wherein said head structure includes lips or eyes parts and means for synchronization of said sound with said fiber optical light simulated movements.

8. A communication display device comprising a see-through tubular structure in the form of an animal, said structure having substantially fixed body, torso, head and limb parts, said tubular structure providing the means for communication with an observer, wherein said head structure includes a brain element and fiber optical means for sumulating messages communicated to and from said brain.

9. A communication display device comprising a see-through tubular structure in the form of an animal, said structure having substantially fixed body torso, head and limb parts, said tubular structure providing the means for communication with an observer, wherein said tubular structure provides a conduit for fiber optical elements.

10. The communication display device of claim 9 wherein said head structure includes a brain element and fiber optical means for simulating messages communicated to and from said brain.

11. The communication display device of claim 10 further including a means for receiving the sound and said sound means adapted for synchronization with said fiber optical means for simulating said messages.

12. The communication display device of claim 11 wherein said sound means is mounted on said limb structure.

13. A communication display device comprising a see-through tubular structure in the form of a humanoid, said structure having substantially fixed body, torso, head and limb tubular parts, said tubular parts providing a hollow conduit for fiber optical elements, and light means for displaying light through said fiber optic elements for simulating movement of at least one of said tubular parts thereby providing the means for communication to an observer.

14. The communication display device of claim 13 further including a means for producing sound, said sound means adapted for synchronization with said fiber optic light simulating movements.

15. The communication display device of claim 14 wherein said head structure includes fiber optic elements simulating lips or eyes parts for simulating movement of said lips or eyes parts.

* * * * *